US006405848B1

(12) United States Patent
Babler

(10) Patent No.: US 6,405,848 B1
(45) Date of Patent: Jun. 18, 2002

(54) ESCALATOR STEP WITH INTEGRAL GUIDE ROLLER MOUNTING MEANS

(75) Inventor: Walter Babler, Perchtoldsdorf (AT)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 09/447,114

(22) Filed: Nov. 22, 1999

(51) Int. Cl.[7] ..... B66B 23/12
(52) U.S. Cl. ..... 198/333
(58) Field of Search ..... 198/332, 333

(56) References Cited

U.S. PATENT DOCUMENTS 5,350,049 A * 9/1994 Ahls et al. ..... 198/333
6,039,167 A * 3/2000 Vellinga ..... 198/333

FOREIGN PATENT DOCUMENTS

DE 4134626 10/1992
GB 1373795 11/1974
WO 9523758 9/1995

* cited by examiner

*Primary Examiner*—Joseph E. Valenza
(74) *Attorney, Agent, or Firm*—Schweitzer Cornman Gross & Bondell LLP

(57) ABSTRACT

In an escalator step having respective supports at each side of its underside, a first fastening is provided at an upper support end for a transport chain and a second fastening is provided at the lower support end for a guide roller. The second fastening consists of a cantilever arm and a bearing pin with a bore, which are integrated components of the escalator step, wherein the escalator step, cantilever arm, bearing pin and bore are produced as a single unitary casting. A countersunk self-tapping screw is used for fixing a guide roller bearing on the bearing pin. A washer lying under the screw presses on an outer ring of the bearing, whereby the bearing is exactly positioned against a shoulder of the bearing pin and held by the washer.

4 Claims, 1 Drawing Sheet

ESCALATOR STEP WITH INTEGRAL GUIDE ROLLER MOUNTING MEANS

The invention relates to an escalator step or a moving walkway plate, wherein a guide roller mounting for reception of a guide roller is arranged at a step body or plate body and is formed integrally with the step or plate.

BACKGROUND OF THE INVENTION

An escalator step with supports integrated into a cast body has become known from International Application specification WO 95 123758. A respective support is arranged at each step side, wherein a fastening for a transport chain and a fastening for a guide roller are provided at the support. For fastening the guide roller, a pin, which serves as a bearing seat for the guide roller, is fixed into the support.

The production of the escalator step or the moving walkway plate in accordance with, such known structure is complicated and costly due to the fixing of the bearing pins.

BRIEF DESCRIPTION OF THE INVENTION

It is accordingly a purpose of the present invention to avoid the disadvantages of the known equipment and present an escalator step or a moving walkway plate which can be produced efficiently and optimized in terms of cost.

In accordance with the invention an escalator step has first and second fastenings provided at side supports on the underside of the step. The second fastening consists of a cantilever arm and bearing pin. The escalator step, cantilever arm and bearing pin are formed as a unitary piece in a single casting A bearing can be mounted directly upon the cast bearing pin, and may be held in place by a self-threading screw tapped into a bore in the bearing pin A washer is used to press upon a ring of the bearing whereby the bearing is maintained in position against a shoulder of the bearing pin.

The advantages achieved by the invention are essentially to be seen in that the manufacturing process for the step or the plate is simplified, because inserted parts are no longer necessary. Moreover, the production of the casting mould or press die is simplified. As a prefabricated fastening for the guide roller is producible in one piece with the step or plate, the subsequent mounting of the roller and the means for that purpose are also simplified. Due to the simplification of the manufacturing process, the casting mould or press die as well as the assembling of the guide roller, substantial cost savings are possible overall. Moreover, replacement rollers can be easily and quickly exchanged.

BRIEF DESCRIPTION OF THE DRAWINGS

The invention is explained in more detail in the following detailed description and drawings illustrating a preferred, but nonetheless illustrative embodiment, wherein.

DETAILED DESCRIPTION OF THE INVENTION

Figure 1:
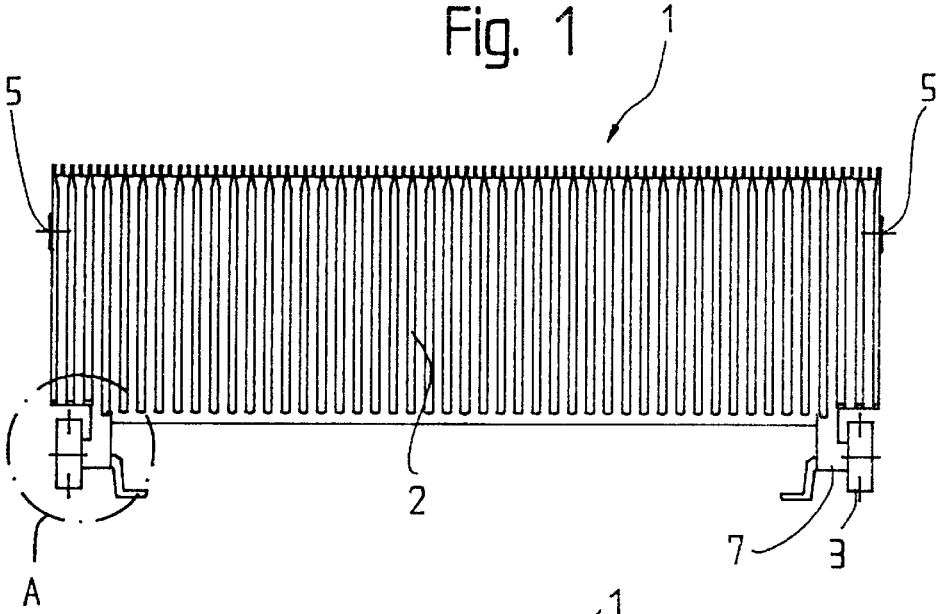
FIG. 1 is a front view of a step body of an escalator step in accordance with the invention.
Figure 2:
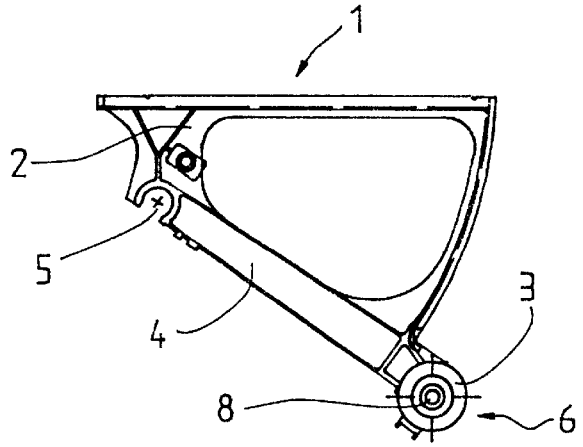
FIG. 2 is a side elevation view of the step body.
Figure 3:
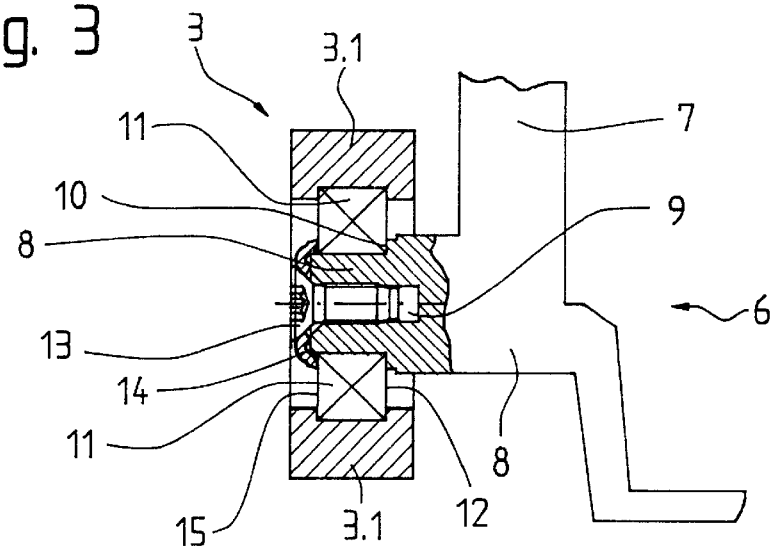
FIG. 3 is a detail view, in section, of the fastening for a guide roller.

An escalator step, which essentially consists of a step body 2 made, for example, from aluminum or synthetic material and fastenings for guide rollers 3 having running surfaces 3.1, is designated by 1 in FIGS. 1 to 3. Moving walking plates have a comparable construction. In the further course of description, for reasons of simplicity reference is made merely to an escalator step, but the explanations are equally valid for a moving walkway plate. Thus, as used herein, the term "escalator step" is intended to encompass moving walkway plates, while the term "step body" encompasses a plate body of a moving walkway. At the underside of the step body 2, the step body 2 has at each side a respective support 4, wherein a first fastening 5 for a transport chain, which is not illustrated, is provided at the upper support end and a second fastening 6 for the guide roller 3, also termed trailing roller, is provided at the lower support end.

FIG. 3 shows a section, referencing the portion "A" in FIG. 1, of the second fastening 6, which is constructed as an extension of the step body 2 and consists of a cantilever arm 7 and a right-angle bearing pin 8 with a bore 9, wherein the step body 2, support 4, first fastening 5, cantilever arm 7 and bearing pin 8 having bore 9 are made from one piece. The bearing pin 8, which is provided with a shoulder 10, can be finished to accept a bearing 11 of the guide roller 3, wherein the bearing 11 has an inner ring 12 and an outer ring 15. Neither the bearing pin 8 nor the bore 9 has to be subsequently processed. The bearing 11 can be pushed onto the bearing pin 8, wherein the inner ring 12 of the bearing 11 bears against the shoulder 10. In order to eliminate the working process of thread-cutting in the bore, a screw 13 formed as a self-tapping screw may be used for mounting the bearing 11. The self-tapping screw 13 plastically forms an exact intimal thread in the bore 9. On tightening of the screw 13, a washer 14, having a concentric wave shape and which lies under the head of the screw, presses on the outer ring 15 of the bearing 11, whereby the bearing is exactly positioned at the shoulder 10 and held by the washer 14. The screw and washer may be removed and reinstalled as required for baring replacement.

I claim:

1. An escalator step, comprising an escalator step body and a guide roller mounting formed as a one-piece construction, wherein the guide roller mounting is an extension of the step body, the guide roller mounting comprising a cantilever arm and a bearing pin having a bore.

2. The escalator step according to claim 1, wherein the bearing pin has a peripheral positioning shoulder for a guide roller bearing.

3. The escalator step according to claim 1, further including a self-tapping screw mounted in the bore to retain a guide roller on the bearing pin.

4. The escalator step according to claim 3, further including a washer having a concentric wave shape located under a head of the self-tapping screw for holding fast a bearing of the guide roller.

* * * * *